US006415959B1

(12) United States Patent
Bougamont et al.

(10) Patent No.: US 6,415,959 B1
(45) Date of Patent: Jul. 9, 2002

(54) LOW CAPACITY PUMP WITH ENHANCED COMPATIBILITY

(75) Inventors: Jean-Louis Bougamont, Eu; Hervé Lompech, Incheville; Pierre Dumont, Eu, all of (FR)

(73) Assignee: Rexam SOF AB, Le Treport (FR)

( * ) Notice: Subject to any disclaimer, the term of this patent is extended or adjusted under 35 U.S.C. 154(b) by 0 days.

(21) Appl. No.: 09/806,480

(22) PCT Filed: Oct. 15, 1999

(86) PCT No.: PCT/FR99/02514

§ 371 (c)(1),
(2), (4) Date: Apr. 12, 2001

(87) PCT Pub. No.: WO00/23199

PCT Pub. Date: Apr. 27, 2000

(30) Foreign Application Priority Data

Oct. 16, 1998 (FR) ..... 98 13004

(51) Int. Cl.[7] ..... B67D 5/38

(52) U.S. Cl. ..... 222/159; 222/321.7; 222/321.9; 222/385

(58) Field of Search ..... 222/156, 159, 222/321.7, 321.9, 385, 380

(56) References Cited

U.S. PATENT DOCUMENTS 3,187,960 A * 6/1965 Gorman ..... 222/321
4,607,765 A * 8/1986 Ruscitti ..... 222/321
4,984,702 A * 1/1991 Pierpont ..... 215/272
4,991,747 A * 2/1991 Van Brocklin ..... 222/321
5,016,780 A * 5/1991 Moretti ..... 222/153
5,388,766 A * 2/1995 Buisson ..... 239/333
5,503,306 A * 4/1996 Knickerbocker ..... 222/321.1
5,505,343 A * 4/1996 Knickerbocker ..... 222/321.1
5,697,530 A * 12/1997 Montaner et al. ..... 222/321.2
5,803,318 A * 9/1998 Lina ..... 222/321.2
5,947,340 A * 9/1999 Arnold et al. ..... 222/321.9
5,975,375 A * 11/1999 Renault et al. ..... 222/321.8
6,032,833 A * 3/2000 Olegnowicz ..... 222/321.9
6,196,424 B1 * 3/2001 Bougamont et al. ..... 222/321.9
6,227,413 B1 * 5/2001 Bommer ..... 222/190

OTHER PUBLICATIONS

Callister, Jr., Materials Science and Engineering/4$^{th}$ Eddition/1997.*

* cited by examiner

*Primary Examiner*—William Doerrler
*Assistant Examiner*—Frederick Nicolas
(74) *Attorney, Agent, or Firm*—Bacon & Thomas, PLLC

(57) ABSTRACT

A pump having a plastic body which includes first and second body ends. The first body end of the pump body defines a metering chamber and has an inlet valve including a valve seat and a ball disposed therein. The second body end of the pump body cooperates with a spray tube carrying an outlet valve positioned near a bottom end thereof and mounted for axial movement with respect to the pump body. A helical spring surrounds the spray tube wherein a top end of the spray tube defines a laterally extending shoulder of which the helical spring abuts at one end. Both the pump body and the ball of the inlet valve are fabricated from a transparent or at least translucent plastic material.

8 Claims, 1 Drawing Sheet

LOW CAPACITY PUMP WITH ENHANCED COMPATIBILITY

BACKGROUND OF THE PRESENT INVENTION

The present invention relates to a pump and more particularly to a low-capacity pump for dispensing liquids such as perfumes, and cosmetics or pharmaceuticals.

A conventional pump generally comprises a body made of a plastics material and defining a metering chamber provided at a first end with an inlet valve via which a liquid is fed in from a container, and at a second end with an outlet valve carried by the inner portion of a spray tube mounted to move axially by co-operating with a helical spring.

However, in such a pump, the inlet valve comprises a ball that is made of metal, and that is received inside the pump body in the metering chamber, as are the return means which are generally constituted by a spring that is also made of metal.

Therefore, liquid which remains even for a short time in the metering chamber comes into contact with metal elements, which gives rise to risks that the properties and in particular the quality of the liquid might be modified.

Furthermore, the pump body is made of an opaque plastics material in order to mask the internal metal elements. Unfortunately, the container is often constituted by a flask made of glass or of a transparent plastics material that allows the body of the pump to show through, which gives rise to an appearance that is unsatisfactory.

Furthermore, pumps also exist in which the return means are constituted by a helical spring disposed outside the metering chamber.

However, in such a pump configuration, the return spring is maintained in a slightly compressed state around the outer portion of the spray tube, in particular by its top end abutting against the end wall of a cavity provided in a dispensing head capping the end of said tube.

Therefore, such a pump configuration does not make it possible to separate the pump from the dispensing head safely since the spring would then not be secured to any part, and might be lost, in particular during storage or automatic transfer operations.

In addition, assembly operations are complex because they require prior mounting of the spring.

SUMMARY OF THE INVENTION

An object of the present invention is to solve the above-noted technical problems satisfactorily.

The invention achieves this object by means of a pump characterized in that inlet valve comprises, in particular, a ball that is not made of metal, while the outer portion of the spray tube is provided with a laterally-extending shoulder against which a first end of said spring abuts in wedged manner.

In a particular embodiment, the body and the ball are made of a plastics material that is transparent or at least translucent.

According to an advantageous characteristic, the pump further comprises an inner bushing engaged in said body to close off said chamber around the inner portion of the spray tube, the end wall of said bushing serving to receive in abutment the second end of the spring.

According to another characteristic, the inner end of said bushing forms an abutment for the outlet valve carried by the inner portion of said tube.

According to yet another characteristic, said ball is made of glass or of polypropylene, while the pump body is made of polypropylene.

In a particular variant, the face of the shoulder that is in contact with a first end of the spring is plane and is perpendicular to the axis of the spray tube.

In another variant, the face of the shoulder that is situated closer to the outer end of the spray tube is beveled.

Preferably, said shoulder is formed over the entire periphery of the tube.

The pump of the invention makes it possible to transfer the liquid without any contact with any metal element whatsoever, thereby preserving the qualities of the liquid and simplifying the manufacturing and assembly operations, while offering cost that is low.

Furthermore, all of the components of the pump that are disposed inside the container are made of a material that is translucent or transparent to light, which considerably improves the overall appearance insofar as the pump is almost invisible in the liquid.

BRIEF DESCRIPTION OF THE DRAWINGS

The invention will be better understood on reading the following description with reference to the drawing, in which.

DETAILED DESCRIPTION OF THE PRESENT INVENTION

Figure 1:
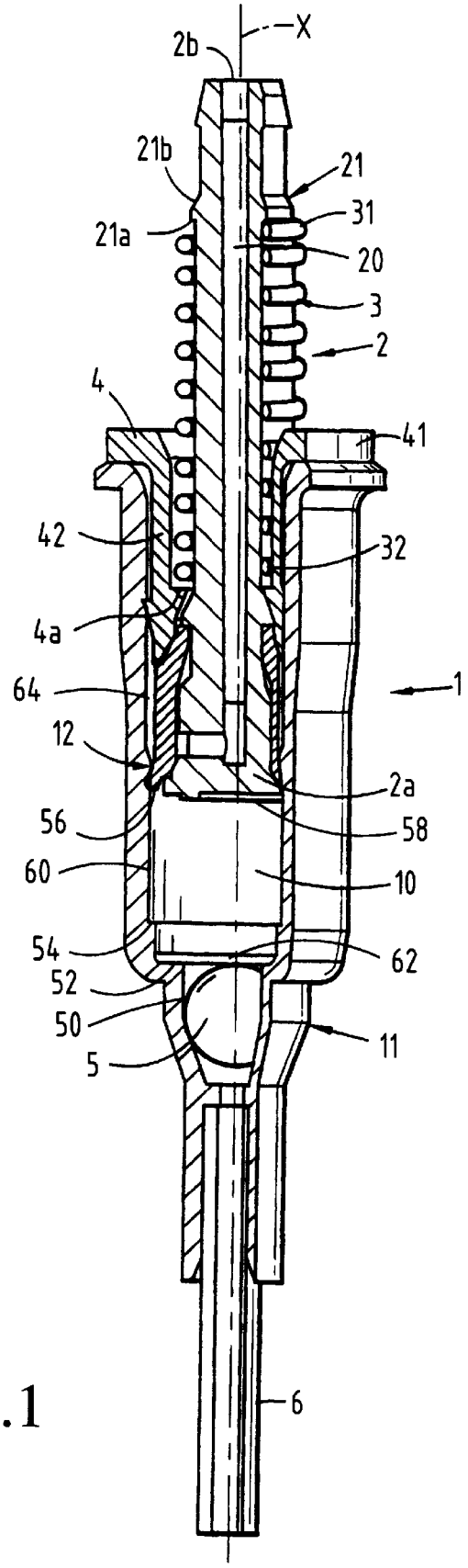
FIG. 1 is a side sectional view of an embodiment of the pump of the invention.

The pump shown in FIG. 1 includes a body 1 made of a plastics material that is transparent or at least translucent, e.g. polypropylene.

The pump body 1 has a first and a second body end 62, 64 which delimit a cavity having an internal body surface 60. Along a lower portion of the cavity, a metering chamber 10 is defined which extends to a closed bottom defined by an inlet valve 11. The inlet valve 11 is defined by a valve seat 50 which accommodates a ball 5 disposed therein to permit fluid to enter the metering chamber 10.

At the second body end 64, opposite from the first body end 62, the chamber 10 is provided with an outlet valve 12 carried by the bottom portion 2*a* of a spray tube 2 defining an axial ejection duct 20.

The spray tube 2 is mounted to move axially by cooperating with a helical spring 3 which urges the valve 12 back into the closed position. The spring 3 is mounted coaxially around the outer portion of the tube 2.

An upper portion of the tube 2 is provided with an outwardly radially extending tube shoulder 21 against which a first end 31 of the spring 3 abuts in wedged manner. The spring 3 is maintained in a slightly compressed state even when the outlet valve 12 is in the closed position.

In this example, the tube shoulder 21 is provided around the entire periphery of the tube 2, and it has a bottom face 21*a* in contact with the turn of the end 31 of the spring 3. In this example, the bottom face 21*a* is further perpendicular to the axis X of the tube 2 and of the pump. The upper face 21*b* of the shoulder that is closer to the outer end 2*b* of the tube 2 is beveled and optionally forms an abutment against which to mount a dispensing head or a push-button (not shown) capping the tube 2.

Preferably, the dispensing head is then provided either with a cylindrical bore enabling it to be engaged into abutment on the end 2*b* of the tube, or else with a cavity of frustoconical profile serving to receive the shoulder 21 by cone-against-cone engagement.

The pump is also provided with an internal bushing 4 engaged into the body 1 to close off the chamber 10 around the inner portion of the spray tube 2.

The bushing 4 is provided with a support collar 41 for resting on the outer edge of the body 1, and the collar is extended inside the chamber 10 by a skirt 42. In the embodiment shown, the skirt 42 is fixed by snap-fastening in the inside side wall of the chamber 10.

The inner end of the skirt 42 forms a high abutment for the outlet valve 12 carried by the inner portion of the tube 2. This abutment corresponds to the closed position of the valve 12. The bushing shoulder 4*a* of the bushing 4 serves to receive in abutment the second end 32 of the spring 3.

A first chamber shoulder 52 is defined by the pump body 1 at the first body end 62, extending radially outward along the internal body surface 60. The spray tube 2 defines a head 58 at its bottom portion and the first chamber shoulder 52 accommodates the profile of the head 58. A second chamber shoulder 54 is similarly defined by the pump body 1 a predetermined distance above the first chamber shoulder 52 and accommodates a profile of a bottom portion 56 of the outlet valve 12.

What is claimed is:

1. A pump for dispensing a volume of fluid from a container comprising:

a pump body having a first and a second body end delimiting a cavity defined by internal body surfaces and forming a metering chamber located near said first body end, said metering chamber extending to a closed bottom defined by an inlet valve positioned below said metering chamber;

said inlet valve including a valve seat defined by said pump body and a ball disposed therein, said valve seat cooperating with said ball to permit the fluid to enter the metering chamber;

a spray tube extending from outside said body into said metering chamber and positioned coaxially to said metering chamber, said spray tube having an outwardly radially extending tube shoulder formed along a top portion of an external surface thereof for receiving one end of a helical spring;

an outlet valve mounted along a bottom portion of said external surface of said spray tube;

said helical spring mounted coaxially around said external surface of said spray tube for biasing said spray tube for axial movement relative to said pump body, said helical spring positioned above said outlet valve relative to and outside of said metering chamber; and wherein said pump body is made from a transparent or at least translucent plastic material and said ball is made from a material selected from the group consisting of glass and polypropylene.

2. The pump according to claim 1 further comprising an inner bushing mounted along the second end portion and extending along said internal body surface above said metering chamber, said inner bushing defining an inwardly radially extending busing shoulder near an end portion thereof to receive another end of said helical spring.

3. The pump according to claim 2 wherein said bushing shoulder defines an abutment to accommodate a top end portion of said outlet valve.

4. The pump according to claim 1 wherein said pump body is made of polypropylene.

5. The pump according to claim 1 wherein a bottom face of said tube shoulder contacts said one end of said helical spring and extends perpendicular to a through axis of said spray tube.

6. The pump according to claim 5 wherein an upper face of said tube shoulder has a beveled profile extending from a top end of said tube shoulder to a portion near said bottom face.

7. The pump according to claim 1 wherein said tube shoulder extends around the entire periphery of said spray tube.

8. The pump according to claim 1 wherein a first chamber shoulder is defined by said pump body, said first chamber shoulder extending radially outwardly above said valve seat and configured to accommodate a spray tube head defined by said bottom portion of said spray head, and a second chamber shoulder is defined by said pump body, said second chamber shoulder extending radially outwardly above a predetermined distance from said first chamber shoulder and configured to accommodate a bottom portion of said outlet valve.

* * * * *